US009053877B2

(12) United States Patent
Young

(10) Patent No.: US 9,053,877 B2
(45) Date of Patent: Jun. 9, 2015

(54) PLUNGER SWITCH AND METHOD OF USING SAME

(71) Applicant: DELTA SYSTEMS, INC., Streetsboro, OH (US)

(72) Inventor: Dennis R. Young, Sheffield Village, OH (US)

(73) Assignee: Delta Systems, Inc., Streetsboro, OH (US)

( * ) Notice: Subject to any disclaimer, the term of this patent is extended or adjusted under 35 U.S.C. 154(b) by 198 days.

(21) Appl. No.: 13/756,892

(22) Filed: Feb. 1, 2013

(65) Prior Publication Data

US 2013/0199909 A1 Aug. 8, 2013

Related U.S. Application Data

(60) Provisional application No. 61/594,583, filed on Feb. 3, 2012.

(51) Int. Cl.

| | |
|---|---|
| ***H01H 13/70*** | (2006.01) |
| ***H01H 13/14*** | (2006.01) |
| *H01H 1/36* | (2006.01) |
| *H01H 13/18* | (2006.01) |

(52) U.S. Cl.

CPC ..... *H01H 13/14* (2013.01); *H01H 1/36* (2013.01); *H01H 13/18* (2013.01)

(58) Field of Classification Search

CPC ..... H01H 13/12; H01H 13/14; H01H 13/18; H01H 13/365; H01H 1/36

USPC ..... 200/345, 16 B, 276, 276.1, 290

See application file for complete search history.

(56) References Cited

U.S. PATENT DOCUMENTS

| | | | | | |
|---|---|---|---|---|---|
| 3,624,330 | A | * | 11/1971 | Bognar et al. | 200/534 |
| 4,812,604 | A | | 3/1989 | Howard | |
| 4,839,478 | A | | 6/1989 | Howard | |
| 4,894,019 | A | | 1/1990 | Howard | |
| 4,939,328 | A | * | 7/1990 | Smith | 200/527 |
| 5,132,499 | A | * | 7/1992 | Valenzona et al. | 200/526 |
| 5,221,816 | A | | 6/1993 | Williams | |
| 5,424,502 | A | | 6/1995 | Williams | |
| 5,528,007 | A | * | 6/1996 | Williams et al. | 200/16 B |
| 5,613,598 | A | * | 3/1997 | Pittman et al. | 200/295 |
| 5,775,482 | A | | 7/1998 | Wolfe et al. | |
| 5,947,268 | A | * | 9/1999 | Lange et al. | 200/345 |
| 6,207,910 | B1 | | 3/2001 | Harvey et al. | |
| 6,483,061 | B1 | * | 11/2002 | Harvey et al. | 200/532 |
| 6,618,022 | B2 | | 9/2003 | Harvey | |

(Continued)

*Primary Examiner* — Kyung Lee

(74) *Attorney, Agent, or Firm* — Tarolli, Sundheim, Covell & Tummino LLP

(57) ABSTRACT

A plunger switch and method comprises a multi-action plunger arrangement having first and second plungers in axial alignment such that the first plunger is centrally located about the second plunger. The second plunger has an annular wall for supporting at least one conductive wiper contact. The plunger switch further comprises first and second biasing members having differing load constants, such that the first and second plungers are actuated at different loads during use and a plurality of terminals for communicating an electrical path. The switch also comprises a housing having a central opening for supporting the plunger arrangement. The second plunger and second second biasing member cooperate with the conductive wiper contact such that compressing of the second biasing member from a normal position to a first actuated position results in a change of state of the switch assembly.

19 Claims, 7 Drawing Sheets

(56) References Cited

U.S. PATENT DOCUMENTS

| | | | | |
|---|---|---|---|---|
| 7,060,917 | B1 * | 6/2006 | Park | 200/16 B |
| 7,064,639 | B2 | 6/2006 | Harvey et al. | |
| 7,446,269 | B2 * | 11/2008 | Stringos | 200/16 B |
| 7,488,914 | B2 | 2/2009 | Kahnert et al. | |
| 8,921,724 | B2 | 12/2014 | Young | |
| 2008/0029376 | A1 * | 2/2008 | Ngoagouni | 200/345 |
| 2010/0224472 | A1 * | 9/2010 | Horikoshi et al. | 200/345 |

* cited by examiner

PLUNGER SWITCH AND METHOD OF USING SAME

CROSS REFERENCES TO RELATED APPLICATIONS

The following application claims priority to U.S. Provisional Patent Application Ser. No. 61/594,583 filed Feb. 3, 2012 entitled PLUNGER SWITCH AND METHOD OF USING SAME. The above-identified application is incorporated herein by reference in its entirety for all purposes.

TECHNICAL FIELD

The present disclosure relates to electrical switches, and more particularly to a switch assembly including one or more wiper contacts that are actuated by multi-action plunger arrangement, the one or more wipers selectively bridging a respective gap between spaced terminals depending on the relative position of the multi-action plunger arrangement.

BACKGROUND

Electrical switches using push button or plunger type switch actuators have many applications including use in automobile car doors, ignition circuits, power take-offs for lawn mowers and garden tractors, refrigerator doors, home appliances, and the like. These push buttons may be normally open, normally closed or a combination of the two.

It is possible to construct switches having more than two terminals which combine the features of normally open and normally closed switches. For example, a "double-pole double-throw" switch behaves as a normally open switch and a normally closed switch in parallel operated by a single plunger. When the plunger is in a normal position, a pair of normally closed terminals is bridged and a pair of normally open terminals is isolated. Alternatively, when the plunger is moved to an actuated position, the normally open terminals are bridged and the normally closed terminals are isolated. A "single-pole double-throw" switch behaves like a double-pole double-throw switch in which one of the normally open terminals is coupled to one of the normally closed terminals. When the plunger is in the normal position, a common terminal is bridged with a normally closed terminal while a normally open terminal is isolated. Alternatively, when the plunger is in the actuated position, the common terminal is bridged with the normally open terminal while the normally closed terminal is isolated.

Further discussion relating to the different switch constructions can be found in U.S. Pat. No. 5,528,007 entitled PLUNGER SWITCH AND METHOD OF MANUFACTURE that issued on Jun. 18, 1996 and assigned to the assignee of the present disclosure. U.S. Pat. No. 5,528,007 is incorporated herein by reference in its entirety by reference.

SUMMARY

One example embodiment of the present disclosure includes a plunger switch and method of using same comprises a multi-action plunger arrangement having first and second plungers in axial alignment such that the first plunger is centrally located about the second plunger. The second plunger has an annular wall for supporting at least one conductive wiper contact. The plunger switch further comprises first and second biasing members having differing load constants, such that the first and second plungers are actuated at different loads during use and a plurality of terminals for communicating an electrical path. The switch also comprises a housing having a central opening for supporting the plunger arrangement. The second plunger and second second biasing member cooperate with the conductive wiper contact such that compressing of the second biasing member from a normal position to a first actuated position results in a change of state of the switch assembly.

Another example embodiment of the present disclosure includes a switch assembly for use with a lawn tractor comprising a multi-action plunger arrangement having first and second moveable plungers in axial alignment such that the first plunger is centrally located about the second plunger. The second plunger has an annular wall for supporting at least one conductive wiper contact. First and second biasing members are axially aligned such that the first biasing member extends through the center of the second biasing member. The first and second biasing members have differing spring constants, such that the first and second plungers are actuated at different loads during use. The switch assembly further comprises a plurality of terminals for communicating an electrical path and a housing having a central opening for supporting the plunger arrangement. The second plunger and second second biasing member cooperate with the conductive wiper contact such that compressing of the second biasing member from a normal position to a first actuated position results in a change of state of the switch assembly wherein continued compressing of the second biasing member results in compression of the first biasing member from the first actuated position to a second actuated position yielding no change of state in the switch assembly.

While another example embodiment of the present disclosure includes a method of operating a multi-action plunger switch. The method comprises the steps of providing a first plunger that is at least partially retractable and substantially located within a second plunger and supporting at least one conductive wiper contact along an annular wall formed about the second plunger. The method also comprises engaging the first plunger with a first biasing member and engaging the second plunger with a second biasing member, the first and second biasing members having differing load constants such that the first and second plungers translate toward a support housing at different loads that are applied to the plunger during use and structuring the biasing members within the support housing such that engaging a first end of the first plunger with a first load causes the first and second plungers to translate from a normal position toward the support housing such that the second plunger translates at least partially inside of the housing to form a first actuated position. The method also comprises the step of structuring the biasing members within the support housing such that engaging the first end of the first plunger with a second load greater than the first load causes the first plunger to translate from the first actuated position to a second actuated position where the first plunger is at least partially inside of the second plunger.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout unless otherwise noted. The present disclosure relates to electrical switches, and more particularly to a switch assembly including one or more wiper contacts that are actuated by multi-action plunger arrangement, the one or more wipers selectively bridging a respective gap between spaced terminals depending on the relative position of the multi-action plunger arrangement.

Figure 1:
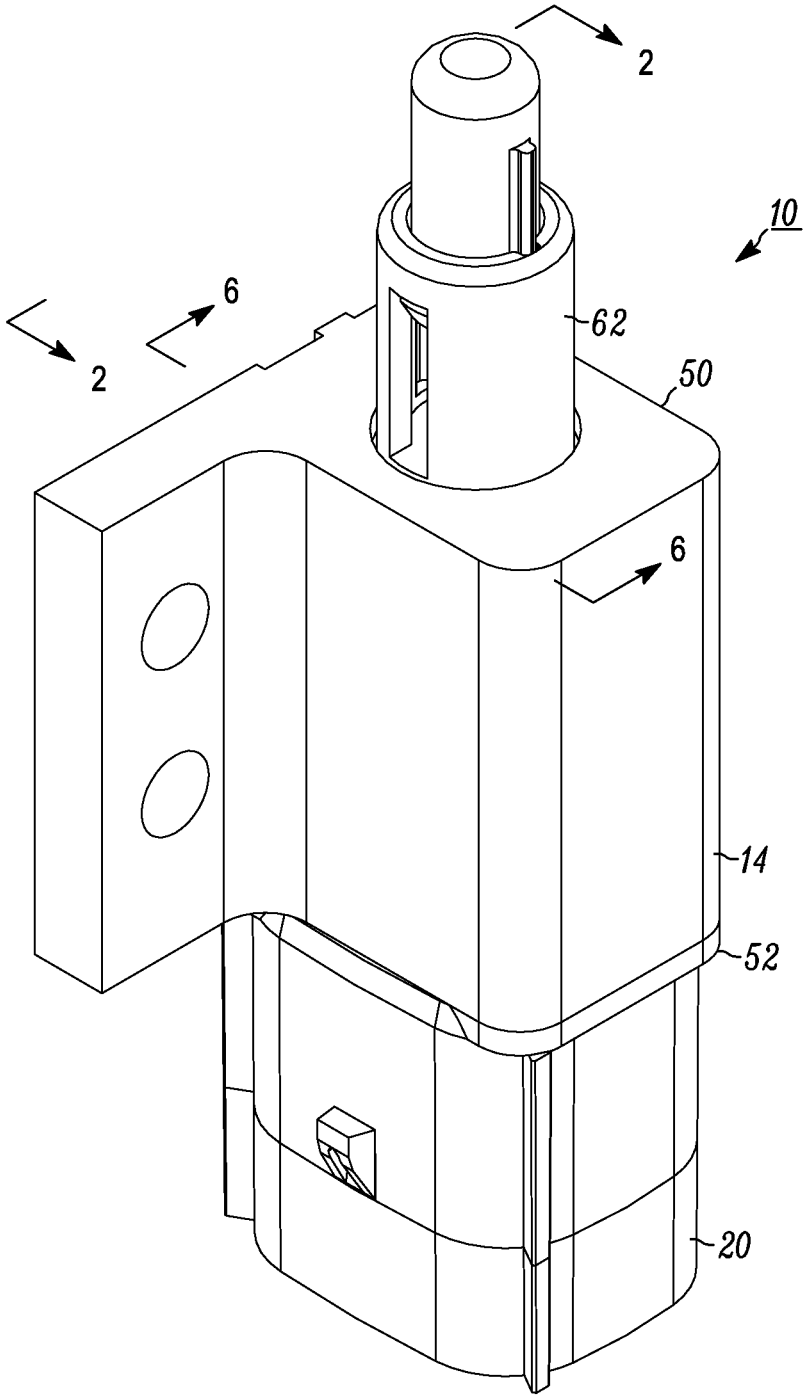
FIG. 1 is perspective view of a switch assembly constructed in accordance with one example embodiment of the present disclosure.

FIG. 1 illustrates a perspective view of switch assembly 10 constructed in accordance with one example embodiment of the present disclosure. The switch assembly 10 as would be appreciated by one of ordinary skill in the art operates in both a normally open "NO" or normally closed "NC", single-pole double-throw, and double-pole double throw configurations, based on the construction of the internal wipers and their contact combinations with terminals, as further discussed below and in U.S. Pat. No. 5,528,007, which is incorporated herein by reference in its entirety. One application of the switch assembly 10 includes a power take-off for a lawn mower, controlling the transfer of power from an engine output shaft to an accessory such as the lawn mower blades.

The switch assembly 10 comprises a multi-action plunger arrangement 12, an upper housing 14, terminals 16, a terminal guide 18, and a lower housing 20. The multi-action plunger arrangement 12 comprises a first plunger 22, a second plunger 24, a first biasing member 26, a second biasing member 28, and conductive wiper contacts 30, 32. The terminals 16 extend from the upper housing 14 through the guide 18 and out the lower housing 20 into a cavity area 34. Within the cavity area 34 of the lower housing 20, the terminals 16 are coupled to, and in communication with an external circuit (not shown).

In one example embodiment, the upper and lower housings, 14, 20, and first and second plungers, 22, 24, and guide 18 are molded from plastic. The upper and lower housings 14, 20 are hermetically welded after assembly to create a moisture and contaminate tight seal for the components coupled to, and within the switch assembly 10. In an alternative example embodiment, the housings 14, 20 are held together with an adhesive.

The terminals 16 are made from a conductive material such as metal. While four terminals are shown such that the combination includes at least one NC, one NO, and one common terminal, any number of terminals could be used without departing from the spirit and scope of the claimed disclosure.

Figure 4:
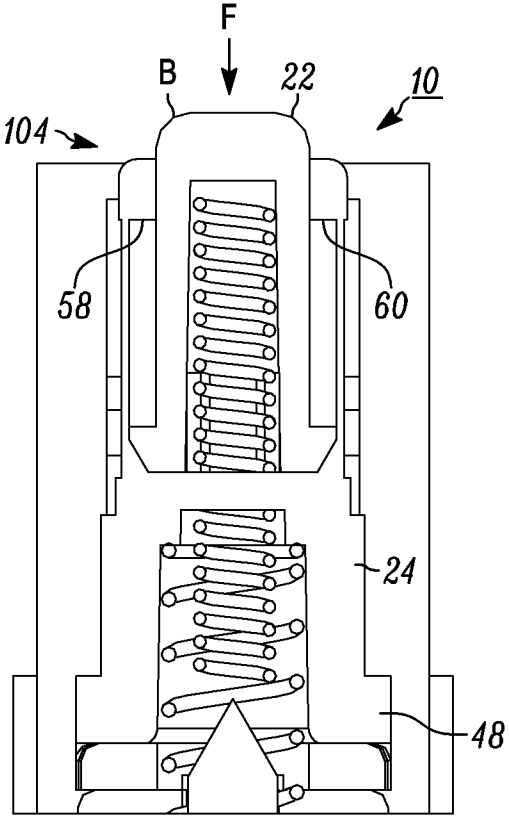
FIG. 4 is a partial sectional view of FIG. 2 illustrating the switch assembly in a second actuated position.
Figure 6:
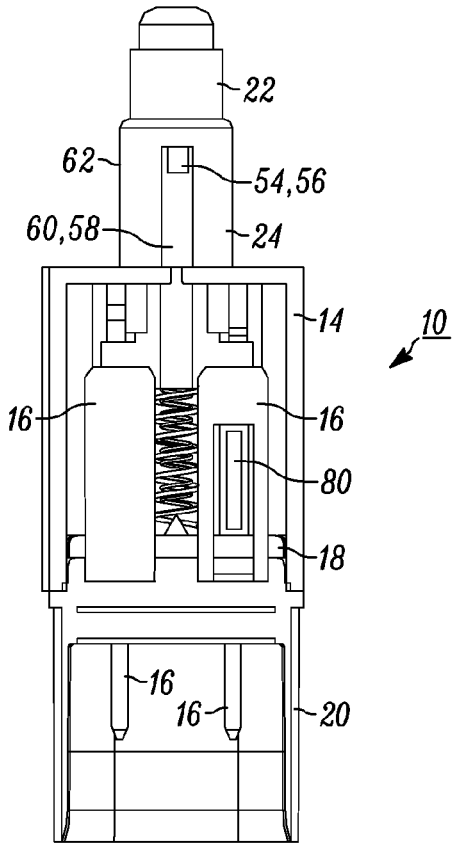
FIG. 6 is a second side sectional elevation view of FIG. 1 along section lines 6-6, the switch assembly in the normal position.
Figure 7:
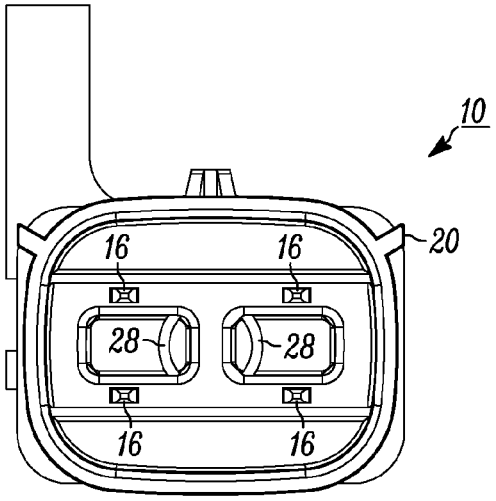
FIG. 7 is a bottom view of the switch assembly of FIG. 1.

Biasing members 26 and 28 in the illustrated example embodiment are coil compression springs. The diameter of the first biasing member 26 is less than the diameter of the second biasing member 28, allowing for the passage of the first biasing member to have internal movement free from, and relative to the second biasing members' center diameter during assembly and operation as illustrated in FIGS. 4 and 6.

In the illustrated example embodiment, the first biasing member 26 is stiffer than the second biasing member 28, that is, the first biasing member has a higher spring constant K in units of Newtons/meter (N/m) than the second biasing member. In one example embodiment, the biasing members are both made from spring steel. However, the biasing members could be formed from plastic or other materials providing similar strength and size aspects.

The second biasing member 28 at its lower end is positioned on a conical post 36 molded into and projecting upward from the lower housing 20. The conical post 36 converges upward, providing the symmetrical positioning of the second biasing member 28 within the switch assembly 10 and during operation. While the first biasing member 26 is symmetrically positioned within the second biasing member 28 and during operation through a guide opening 27 located within the second plunger 24. In an alternative example embodiment, the first biasing member 26 in addition to being guided by opening 27, is also guided by resting on conical post 36 inside the second biasing member 28.

Figure 2:
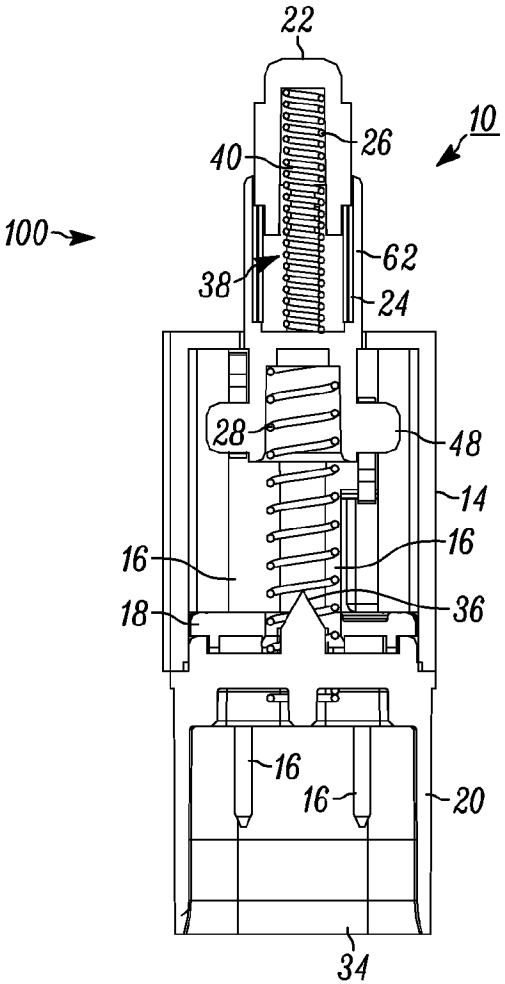
FIG. 2 is a first side sectional elevation view of FIG. 1 along section lines 2-2, the switch assembly in a normal position.
Figure 5:
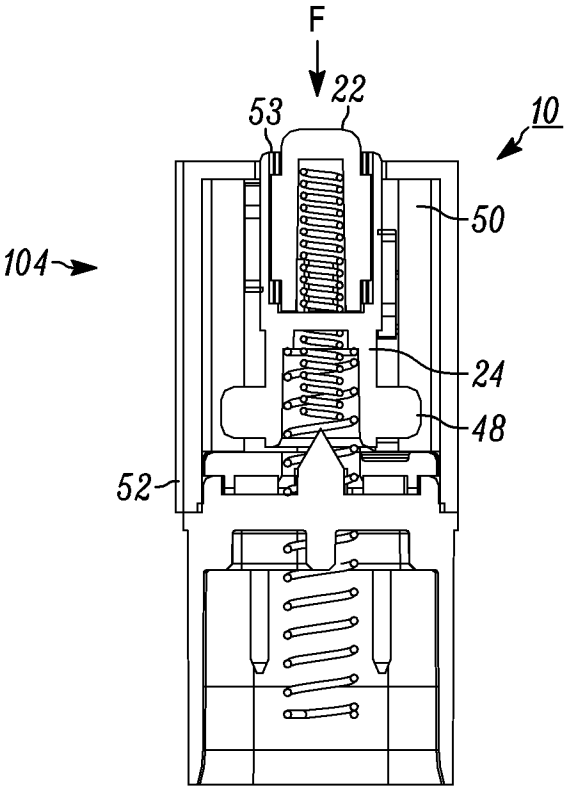
FIG. 5 is a sectional view of FIG. 2 illustrating the switch assembly in the second actuated position.

At an opposite end, the first biasing member 26 is supported and carried by a blind opening 38 and support post 40, both centrally molded into the first plunger 26, as illustrated in FIG. 2. The second biasing member 28 is supported and carried by a counter bored recess 42 having a diametrical stop 44 and centrally located within the the second plunger 24.

In the illustrated example embodiment, the first biasing member 26 is longer than the second biasing member 28, has a diameter of ⅛", and gauge thickness greater than the second biasing member. In the illustrated example embodiment, the second biasing member 28 has a diameter of 3/16.

Forming part of the second plunger 24 are conductive wiper contacts 30 and 32. The wiper contacts 30 and 32 are opposing diametrically disposed about the second plunger 24 wall 62. In particular, the wiper contacts 30, 32 each comprise an apex 66 dividing symmetrically shaped sides 68, 70. The apex 66 is nested about central bosses 72 molded and projecting from the wall 62 of the second plunger 24. Two retaining flanges 74 project laterally from the wall 62, each to one side of each central boss 72.

During assembly, the contacts 30 and 32 are opposing diametrically disposed about the second plunger 24 annular wall 62 by positioning the apex 66 over the central boss 72 in contact with the wall and concomitantly biasing inward the both sides 68, 70 such that each is secured inwardly of the retaining flanges 74. In the illustrated embodiment, the wiper contacts are respectively invertedly positioned on the second plunger 24. That is, the apex 66 of wiper 30 is facing away from the first plunger 22, while wiper 32 is facing toward the first plunger.

In one example embodiment, the wiper contacts 30, 32 are formed from conductive material. In the illustrated example embodiment, the wiper contacts 30, 32 are either leaf springs formed from strips of metal having constant widths or wire "V" springs. Although the design of the switch assembly 10 could be adapted for torsion springs having central coils.

The first and second plungers 22, 24, are relatively coactable within the upper housing 14 through a main opening 46 molded therein. The relative coacting movement allows for independent linear translation about longitudinal axis X between the first and second plungers 22, 24 as further discussed below. The second plunger 24 translates within, yet is also retained within the first housing 14 at a first end 50 by annular stop 48 that is larger than the main opening 46. Once inserted into the upper housing 14, the second plunger 24 is retained by the guide 18 and/or lower housing 20 at a second end 52 of the upper housing.

The first plunger 22 translates within, yet is also retained by a central opening 53 located in the second plunger 24. The first plunger 22 is retained in the second plunger 24 through axially disposed wings 54, 56 laterally projecting from the first plunger that pass into and out corresponding longitudinal slots positioned in the wall 62 of the second plunger. The first biasing member 26 biases the first plunger 22 such that the wings 54, 56, are located at an upper end 64 of the second plunger 24 when the switch assembly is in a normal or rest position as illustrated in FIGS. 1, 2 and 6.

Illustrated in FIGS. 2-5 are sectional views of the switch assembly 10, and more specifically the figures depict the switch assembly in various positions. That is, in FIG. 2, the switch assembly 10 is located at rest or normal position 100. Illustrated in FIG. 3, the switch assembly 10 is located in a first actuated position 102. Illustrated in FIGS. 4 and 5, the switch assembly 10 is located in a second actuated position 104.

Movement of the multi-action plunger arrangement 12 relative to the upper housing results in a change in state in the terminals 16 with the external circuit coupled to the switch assembly 10. More specifically, the change of state (from NO to NC or NC to NO) occurs as the plunger arrangement 12 is actuated by the force F from the normal or rest position 100 to the first actuated position 102. While the change of state (from NO to NC or NC to NO) does not change as the plunger arrangement 12 is actuated by the force F from the first actuated position 102 to the second actuated position 104.

Such construction of the multi-action plunger arrangement 12 to allow the change of state to remain unaltered from the first actuated position 102 (see FIG. 3) to the second actuated position 104 (see FIGS. 4 and 5), advantageously provides the object (not shown) engaging the switch assembly 10 to over travel the amount necessary for switch activation, while keeping the change of state the same once actuated. Unlike conventional plunger switches that have a limited stroke length posing problems when the travel of the object exceeds the allowable distance, the switch assembly 10 of the present disclosure as shown above when needed allows an additional amount of travel, acting as a safety or clutch in region Z shown in FIG. 3 as the first plunger 22 travels from an upper position A (FIG. 3) to a lower position B (FIG. 4). This also minimizes the adjustment time required in positioning the switch assembly 10 in its application. The safety or clutch region Z of travel acts as a zone of tolerance for positioning the switch assembly for a particular application.

Figure 3:
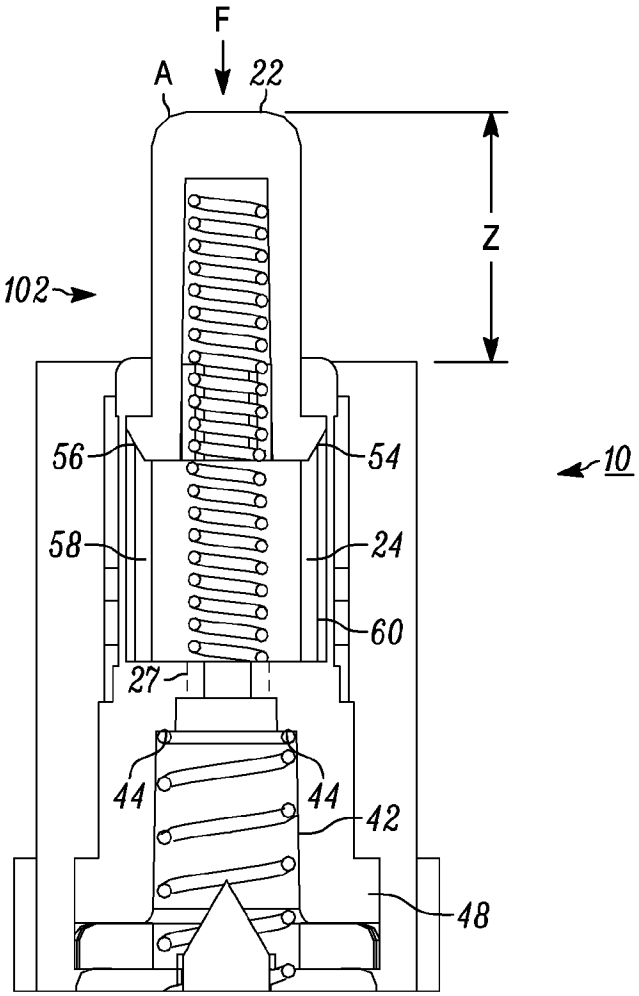
FIG. 3 is a partial sectional view of FIG. 2 illustrating the switch assembly in a first actuated position.

During use the multi-action plunger arrangement 12 when the force F is applied to the first plunger 22, the second biasing member 28 will begin to compress, thus having the second plunger 24 move into the first housing as illustrated from FIG. 2 to FIG. 3. As a result, the electrical state of the switch will changes as the conductive wiper contacts 30, 32 engage or disengage different combination of terminals 16 or gaps 80 located therein. In the illustrated example embodiment, the change in state will occur after the second plunger 24 moves between 0.04 to 0.15 inches toward the upper housing 14, while no movement has occurred to the first biasing member 26.

Figure 8:
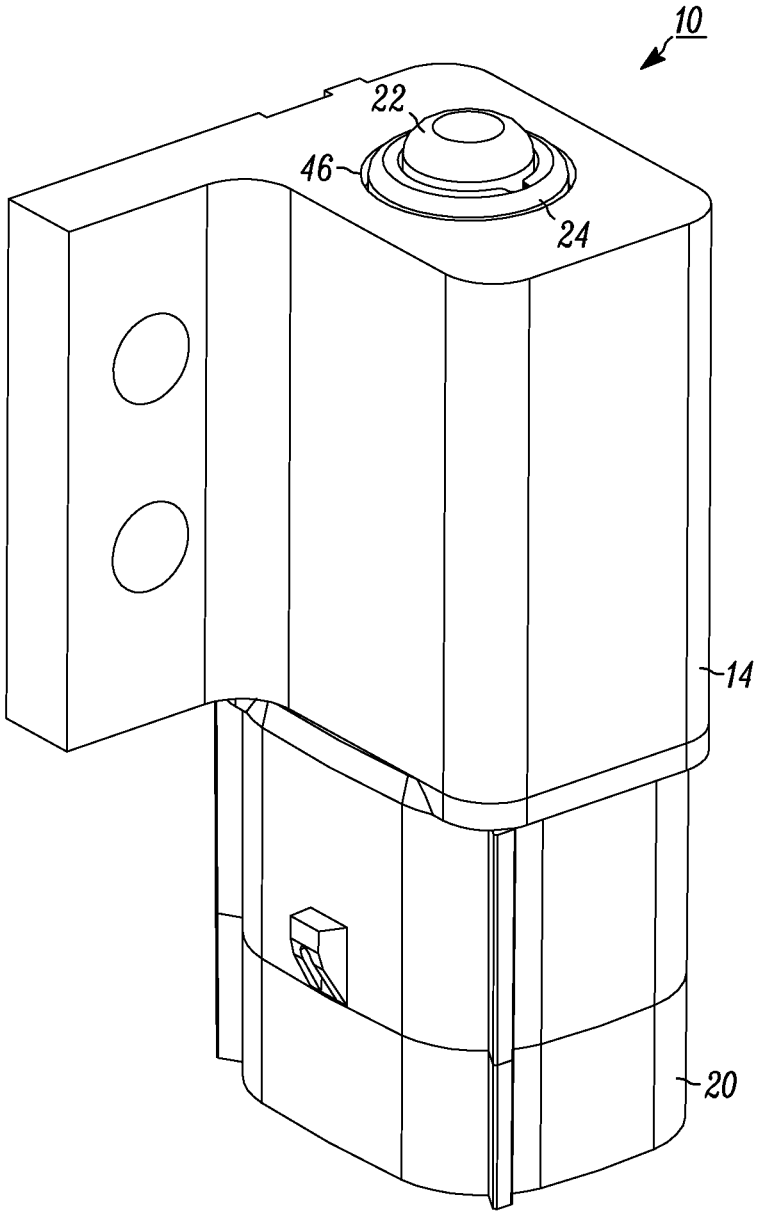
FIG. 8 is an external perspective view of the switch assembly in the second actuated position.
Figure 9:
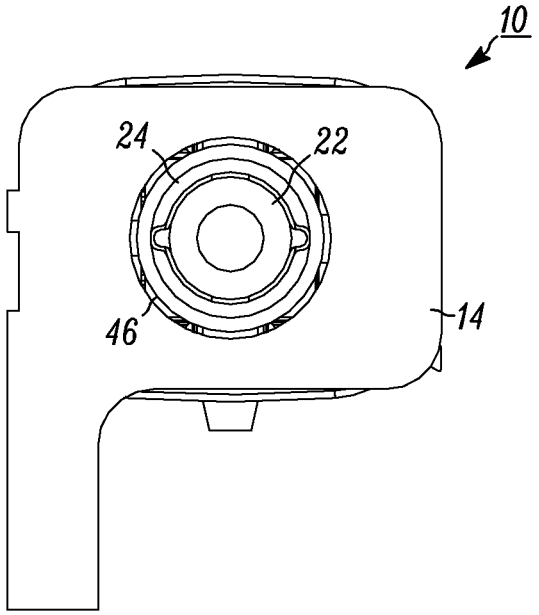
FIG. 9 is a top view of the switch assembly of FIG. 1.

Once the second biasing member 28 is compressed or reaches a load threshold to the point that the second plunger ceases moving downward, the first biasing member 26 will start to compress, allowing the first plunger 22 to move relative to the second plunger 24 into its central opening 53. The traveling of the first plunger 22 as a result of the compression of the first biasing member 26 continues until the top surface of the first plunger is flush with the top surface of the upper housing 14 as illustrated in FIG. 8. The electrical state of the switch assembly 10 will remain unchanged during the downward travel of the first plunger 22 based on the compression of the first biasing member 26 and will not change state again until the second plunger 24 springs back to the normal or rested position 100 of FIG. 2.

The above described cooperative relationship between the first and second plungers achieved by their design, biasing members, and wiper contacts that provides the additional travel allows for direct contact with mechanisms undergoing movement or actuation, advantageously without the expensive use of cams, linkages, or other indirect contact devices. The switch assembly 10 design and cooperative relationship that provides the safety region Z creates more efficient mounting and more cost effective implementation of the switch assembly into the vehicle or selected application.

Figure 10:
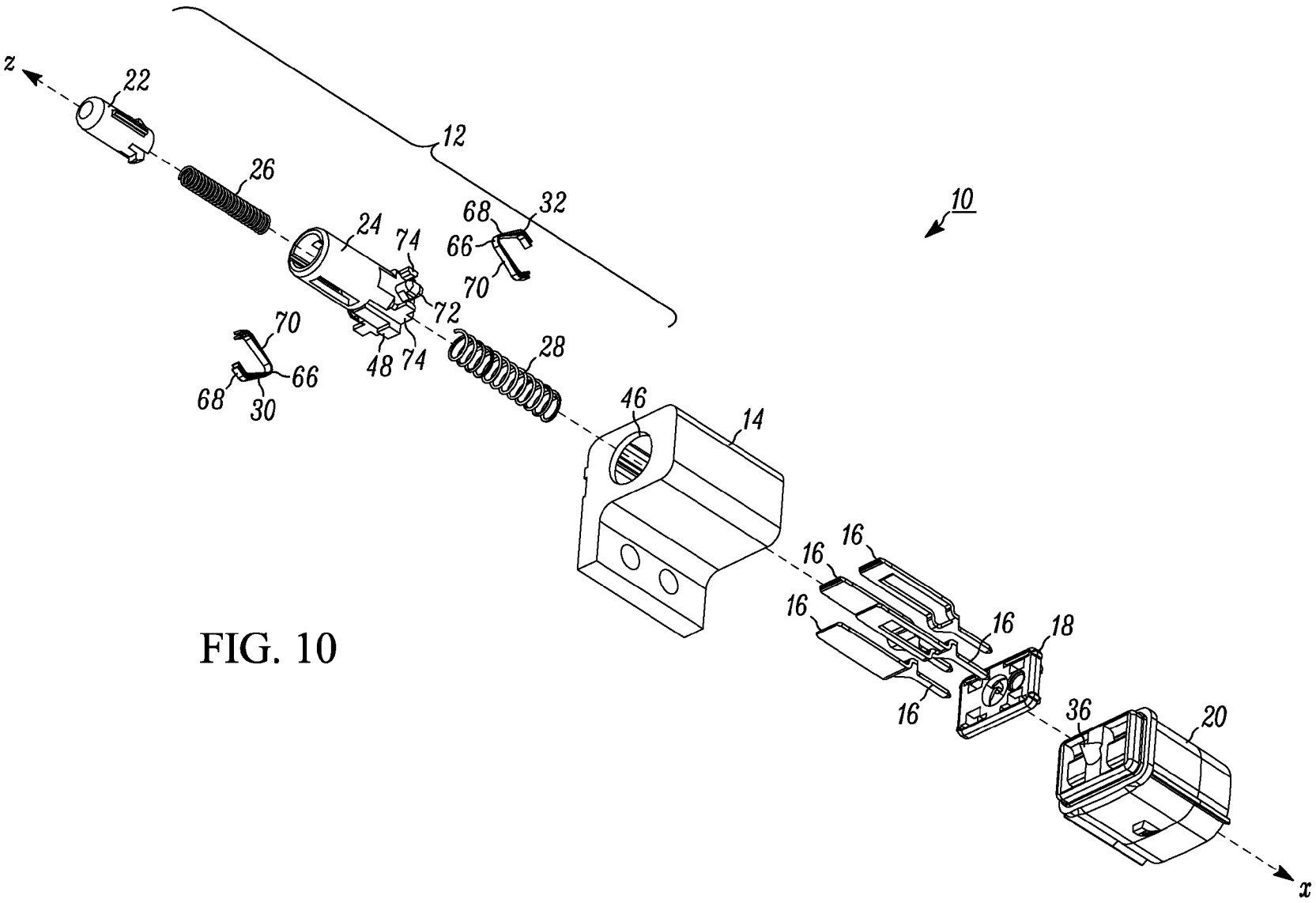
FIG. 10 is an exploded assembly view of the switch assembly of FIG. 1.

Because of the axial alignment of the multi-action plunger arrangement 12 about the x-axis shown in FIG. 10, no side loading occurs during the activation of switch assembly 10. This advantageously reduces failure and wear of the switch assembly 10.

As used herein, terms of orientation and/or direction such as upward, downward, forward, rearward, upper, lower, inward, outward, inwardly, outwardly, horizontal, horizontally, vertical, vertically, distal, proximal, axially, radially, etc., are provided for convenience purposes and relate generally to the orientation shown in the Figures and/or discussed in the Detailed Description. Such orientation/direction terms are not intended to limit the scope of the present disclosure, this application and the invention or inventions described therein, or the claims appended hereto.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A switch assembly comprising:

a multi-action plunger arrangement having first and second plungers in axial alignment such that said first plunger is centrally located about said second plunger;

the second plunger having an annular wall for supporting at least one conductive wiper contact;

first and second biasing members having differing load constants, such that said first and second plungers are actuated at different loads during use;

a plurality of terminals for communicating an electrical path; and a housing having a central opening for supporting said plunger arrangement;

the second plunger and second second biasing member cooperate with said conductive wiper contact such that compressing of said second biasing member from a normal position to a first actuated position results in a change of state of said switch assembly and farther wherein continued compressing of said second biasing member results in compression of said first biasing member from said first actuated position to a second actuated results in no change of state in said switch assembly.

2. The switch assembly of claim 1 wherein said load constant of said first biasing member is greater than the load constant of said second biasing member.

3. The switch assembly of claim 1 wherein said state is one of either normally open and normally closed.

4. A switch assembly for use with a lawn tractor comprising:

a multi-action plunger arrangement having first and second moveable plungers in axial alignment such that said first plunger is centrally located about said second plunger;

the second plunger having an annular wall for supporting at least one conductive wiper contact;

first and second biasing members axially aligned such that said first biasing member extends through the center of said second biasing member, the first and second biasing members having differing spring constants, such that said first and second plungers are actuated at different loads during use;

a plurality of terminals for communicating an electrical path; and a housing having a central opening for supporting said plunger arrangement;

the second plunger and second second biasing member cooperate with said conductive wiper contact such that compressing of said second biasing member from a normal position to a first actuated position results in a change of state of said switch assembly;

wherein continued compressing of said second biasing member results in compression of said first biasing member from said first actuated position to a second actuated position allowing change of state in said switch assembly to remain unchanged.

5. The switch assembly of claim 4 wherein said load constant of said first biasing member is greater than the load constant of said second biasing member.

6. The switch assembly of claim 4 wherein said state is one of either normally open and normally closed.

7. The switch assembly of claim 4 wherein said first and second biasing members are guided at one end by a conical post.

8. The switch assembly of claim 4 wherein said first plunger is at least partially moveably located within said second plunger.

9. The switch assembly of claim 4 wherein said first plunger is an over travel plunger keeping the state of said switch assembly the same whether in a completely compressed state or in a completely unactuated state.

10. The switch assembly of claim 4 wherein said first plunger further comprises wings that engage a first end of said second plunger, said wings remaining in contact as said first end of said second plunger when operating said first and second plunger from said normal position to said first actuated position.

11. The switch assembly of claim 10 wherein said wings of said first plunger are disposed away from contacting said first end of said second plunger when operating said first plunger from said first actuation position to said second actuation position.

12. A method of operating a multi-action plunger switch, the method comprising the following steps of:

providing a first plunger that is at least partially retractable and substantially located within a second plunger, supporting at least one conductive wiper contact along an annular wall formed about said second plunger;

engaging said first plunger with a first biasing member and engaging said second plunger with a second biasing member, said first and second biasing members having differing load constants such that said first and second plungers translate toward a support housing at different loads that are applied to said plunger during use; and structuring said biasing members within said support housing such that engaging a first end of said first plunger with a first load causes said first and second plungers to translate from a normal position toward said support housing such that said second plunger translates at least partially inside of said housing to form a first actuated position; and structuring said biasing members within said support housing such that engaging said first end of said first plunger with a second load greater than said first load causes said first plunger to translate from said first actuated position to a second actuated position where said first plunger is at least partially inside of said second plunger.

13. The method of claim 12 further comprising the step of changing the state of said multi-action plunger switch by compressing said second biasing member from said normal position to said first actuated position.

14. The method of claim 12 further comprising the step of changing the state of said multi-action plunger switch by compressing said second plunger from said non al position to said first actuated position.

15. The method of claim 12 further comprising the step of changing the state of said multi-action plunger switch by translating said conductive wiper contact coupled to said second plunger and compressing said second plunger and second biasing member from said normal position to said first actuated position.

16. The method of claim 15 further comprising the step of changing the state of said multi-action plunger switch by translating said conductive wiper contact coupled to said second plunger and compressing said second plunger and second biasing member from said normal position to said first actuated position.

17. The method of claim 12 wherein said step of structuring further comprises the step of providing a load constant of said first biasing member that is greater than the provided load constant of said second biasing member.

18. The method of claim 12 further comprising the step of guiding said first and second biasing members by a conical post located in said support housing.

19. The method of claim 12 further comprising die step of advancing said conductive wiper contact with the movement of said first and second plungers from said normal position to said first actuated position and holding stationary said wiper contact at said first actuated position when moving said first plunger from said first actuated position to said second actuated position.

* * * * *